United States Patent [19]

Schnier

[11] 4,097,325

[45] Jun. 27, 1978

[54] LABEL-APPLYING APPARATUS FOR APPLYING THERMOPLASTIC LABELS

[75] Inventor: Edward A. Schnier, Hubbardston, Mass.

[73] Assignee: A-T-O Inc., Cleveland, Ohio

[21] Appl. No.: 406,334

[22] Filed: Oct. 15, 1973

[51] Int. Cl.[2] ..... B65C 3/08

[52] U.S. Cl. ..... 156/215; 156/285; 156/306; 156/320; 156/497; 156/499; 156/476; 156/556; 156/583; 156/DIG. 9; 156/DIG. 36; 156/DIG. 42

[58] Field of Search ..... 156/351, 366, 499, 556, 156/557, 558, 285, 306, 497, 542, 583, 483, 559, 484, 485, DIG. 4, DIG. 9, DIG. 29, DIG. 31, DIG. 36, DIG. 42, DIG. 51, 212, 215, 322, 320, 468, 476, 311, 352

[56] References Cited

U.S. PATENT DOCUMENTS

| | | | |
|---|---|---|---|
| 2,940,630 | 6/1960 | Carter | 156/352 |
| 3,433,699 | 3/1969 | Rumble | 156/285 |
| 3,549,457 | 12/1970 | Carter | 156/556 |
| 3,718,525 | 2/1973 | McGuire et al. | 156/556 |
| 3,769,132 | 10/1973 | Cram | 156/311 |
| 3,783,058 | 1/1974 | Solomon et al. | 156/351 |

*Primary Examiner*—David Klein
*Assistant Examiner*—Jerome W. Massie
*Attorney, Agent, or Firm*—Dike, Bronstein, Roberts, Cushman & Pfund

[57] ABSTRACT

In a label-applying machine for applying labels adapted to be rendered adhesive by an application of heat, a vacuum picker for removing the labels one at a time from the magazine and moving them to a transfer position, a vacuum gripper finger at the transfer position for taking the labels from the picker and moving them to a position for application to containers supported for movement along a predetermined path, said gripper fingers being heated to render the labels tacky during movement from the transfer position to the containers for spotting the labels on the containers, and wipers situated along the path of travel of the containers beyond the place of spotting of the labels for pressing the labels against the sides of the containers, and means for heating the wipers to cause the labels to be adhesively attached to the containers.

13 Claims, 12 Drawing Figures

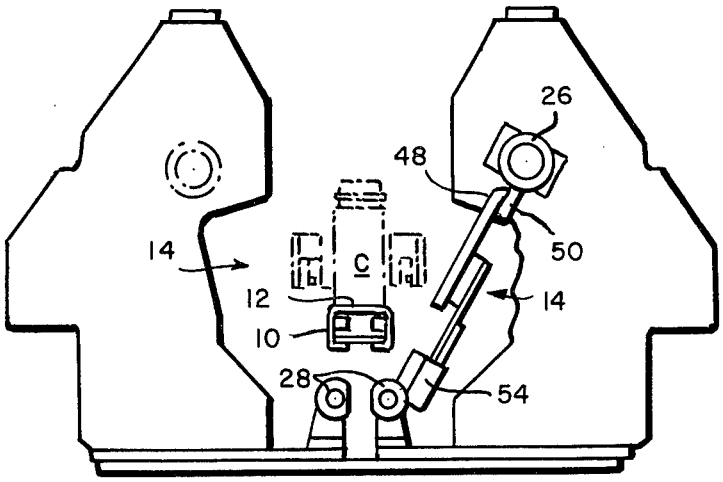
FIG. 1
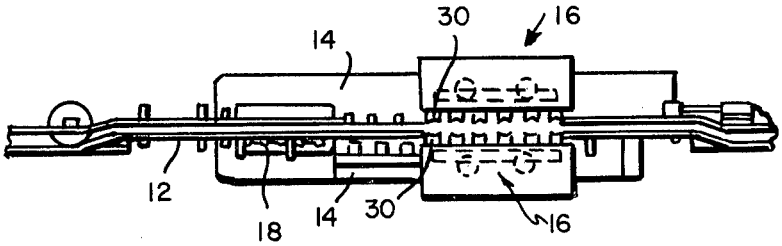
FIG. 2
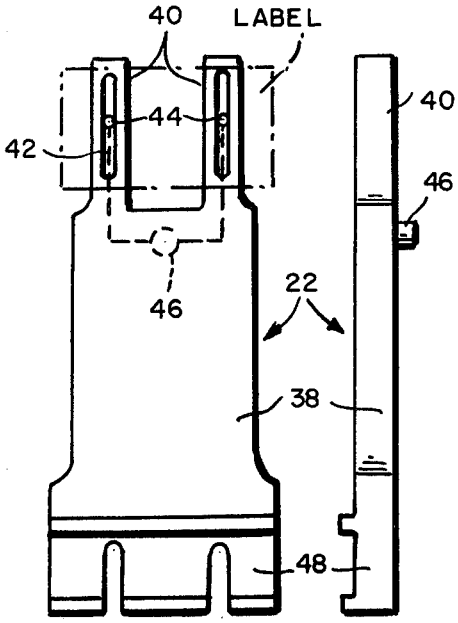
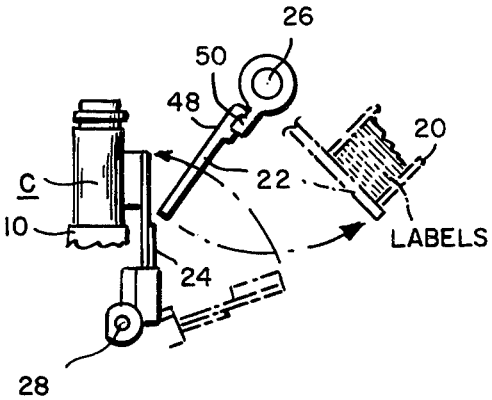
FIG. 4 FIG. 5
FIG. 3

LABEL-APPLYING APPARATUS FOR APPLYING THERMOPLASTIC LABELS

BACKGROUND OF THE INVENTION

It is customary in the application of labels to containers as disclosed in U.S. Pat. No. 2,940,630, to use in combination a picker and gripper finger in an arrangement whereby the picker is provided with a coating of adhesive, is then moved into engagement with the lowermost label in a magazine containing a stack of labels and withdrawn to remove the lowermost label therefrom and move it to a transfer position whereupon the gripper finger is moved into engagement with the adhesive-coated label at the transfer position to take it from the picker and move it into engagement with a container resting on a travelling support. Beyond the place of application of the label to the container, in the direction of movement of the containers, there are one or more groups of wipers which apply pressure to the container to insure complete adhesion of the entire area of the label to the container.

It is the purpose of this invention to provide label-applying apparatus for applying thermoplastic labels in the aforesaid labeling machine disclosed in U.S. Pat. No. 2,940,630, and other like labeling machines by the simple expedient of substituting for the label-applying instrumentalities and the wiping instrumentalities of such machines instrumentalities designed to pick thermoplastic labels from a stack of dry, non-tacky thermoplastic labels which are adapted to be rendered adhesive by the application of heat, transfer them to a gripper finger for application to a container, render the labels tacky as they are moved from the transfer position to the place of spotting and thereafter rendering them adhesive while pressing them into engagement with the containers.

SUMMARY

As herein illustrated, the label machine of this invention is for applying labels which may be rendered adhesive by the application of heat and comprises label-applying instrumentalities and a support for supporting and moving containers along a predetermined path relative to the label-applying instrumentalities. The instrumentalities comprise a magazine for holding a stack of dry labels adapted to be rendered tacky by an application of heat, a vacuum picker movable from the magazine to a transfer position and back for removing labels one at a time from the magazine and moving them to the transfer position, a vacuum gripper finger movable from the transfer position to the support and back again to take labels from the picker and spot them on the containers on the support, and means on the gripper finger for applying heat to the labels during their movement from the transfer position to the support to render the labels tacky. Beyond the place of label application there are wipers movable to and from the path of movement of the containers and reciprocably movable along the path of said containers for applying pressure to the labels spotted on the containers at the place of label application and for heating the labels during the application of pressure to cause them to become completely adhered to the containers. The picker has spaced vacuum fingers between which the gripper finger is movable at said transfer position to take a label supported between the fingers from the picker. The vacuum fingers contain orifices which are adapted to be connected to a source of vacuum as they travel from the magazine toward the transfer position. The gripper finger has on it a pad containing orifices which are also adapted to be connected to a source of vacuum as the finger travels from the place of transfer to the place of application of the label to the container. For heating the labels during their movement from the place of transfer to the place of application a heating element is attached to the pad. The wipers comprise pads of silicone rubber supported by articulated segments for wrapping around the containers as they are moved into compressive engagement therewith and embody heating elements for heating the pads to a temperature such as to render the labels completely adhesive. Preferably the pads are faced with a thin sheet of metal for distributing the heat throughout an area coextensive with the area of the label.

The invention will now be described in greater detail with reference to the accompanying drawings wherein:

FIG. 1 is an end elevation of a labeling machine such as shown in patent 2,940,630, showing a conveyor supporting a container in a position for application of a label thereto, a picker for removing labels from the magazine and presenting them to a transfer position, and a gripper finger for removing the labels from the picker and applying them to the containers on the support;

FIG. 2 is a plan view of the machine showing from left to right the conveyor, label-applying means and wiping means;

Figure 9:
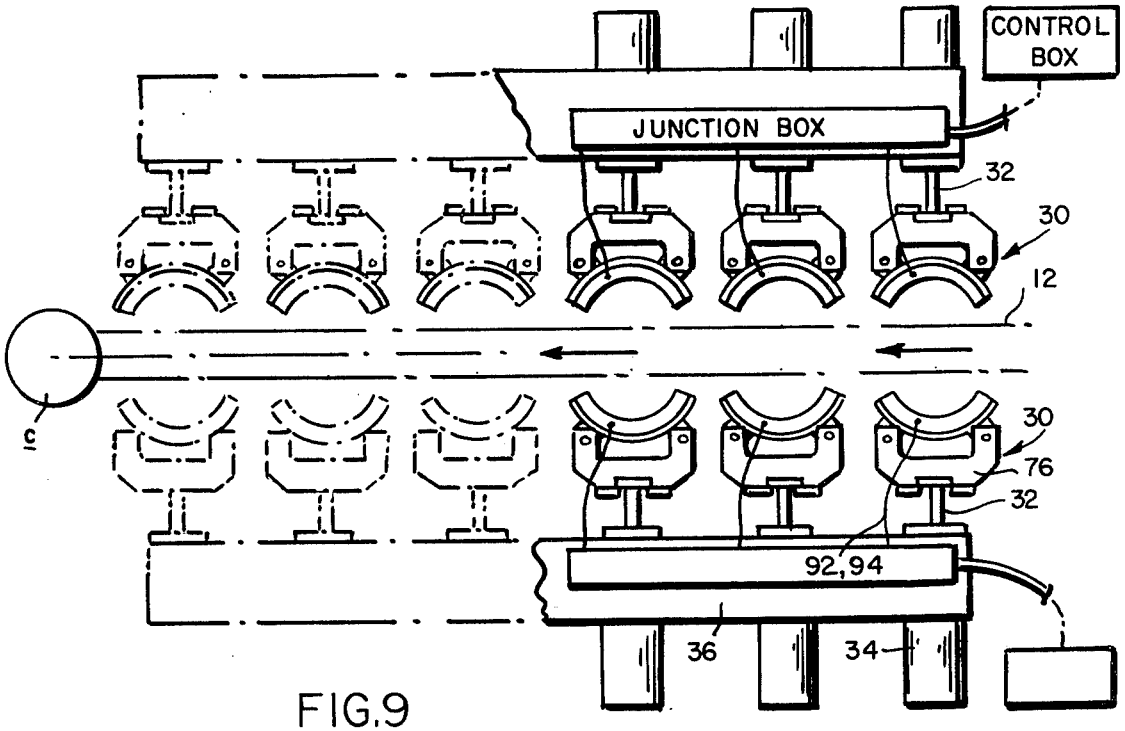
Figure 8:
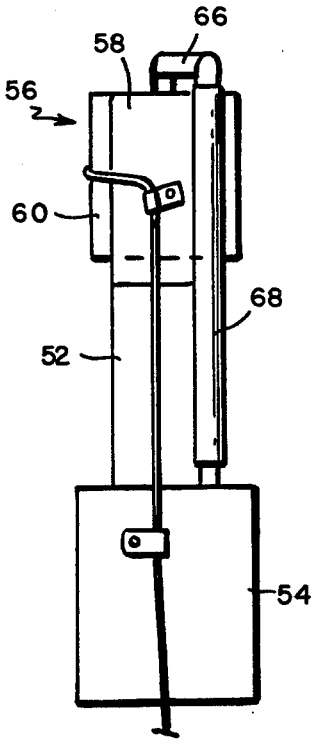
Figure 6:
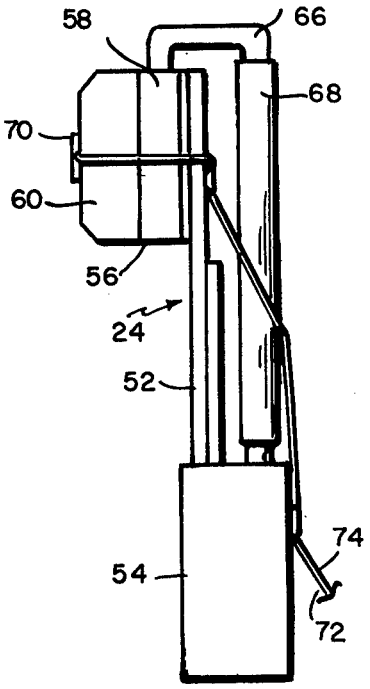
Figure 7:
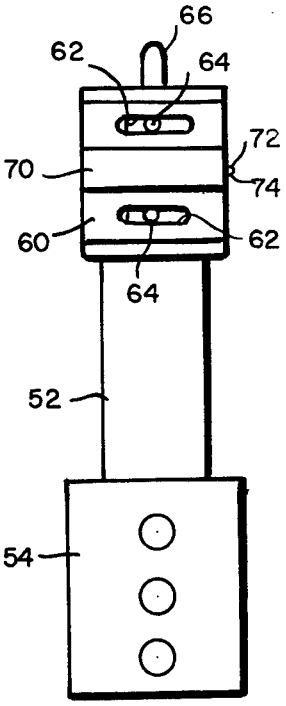
Figure 10:
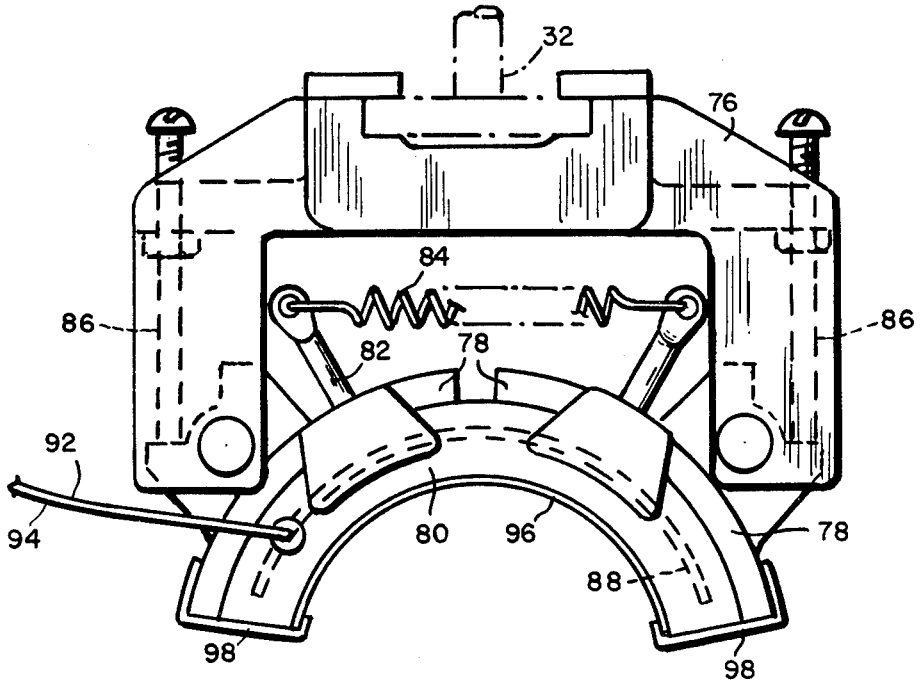
Figure 11:
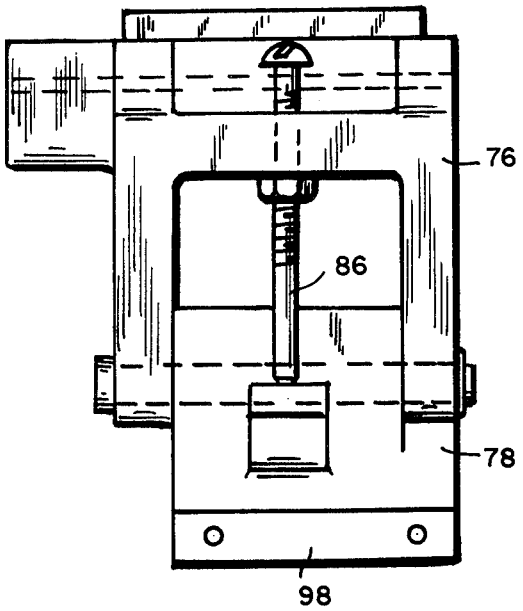

FIG. 3 diagrammatically illustrates the relation of the label magazine, picker and gripper fingers to each other and to the containers to which the labels are to be applied;

FIG. 4 is a plan view of the picker;

FIG. 5 is a side view of the picker;

FIG. 6 is a side view of the gripper finger;

FIG. 7 is a front view of the gripper finger;

FIG. 8 is a back view of the gripper finger;

FIG. 9 is a plan view to larger scale of the wipers;

FIG. 10 is a top view of one of the wipers;

FIG. 11 is a side view of FIG. 10; and

Figure 12:
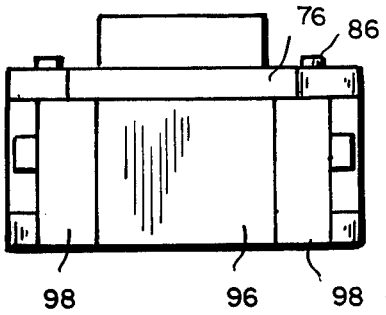

FIG. 12 is a back view.

Referring to the drawings (FIGS. 1 and 2), the labeling machine embodying the invention as herein illustrated is of the kind shown in U.S. Pat. No. 2,940,630, wherein an endless conveyor 10 having an upper horizontal run 12 supports containers C for movement longitudinally of the machine between label-applying means 14—14 at opposite sides and beyond the label-applying means wiper means 16—16. In this machine there are three equally spaced label-applying instrumentalities at each side and two groups of three equally spaced wiper means at each side. The containers are delivered to the conveyor 10 which, in turn, presents the container to a feed screw 18, the feed screw operating to position the containers at uniformly spaced intervals for presentation to the label-applying means and to the wiping means.

Each label-applying means 14, as diagrammatically illustrated in FIG. 3, comprises a magazine 20, a picker 22 and a gripper finger 24. The picker 22 is mounted on a horizontal shaft 26 for movement along an arcuate path from a position adjacent the magazine 20 to a transfer position. The gripper finger 24 is mounted on a horizontal shaft 28 for arcuate movement along a path which intersects the path of arcuate movement of the picker at the transfer position of the latter and from thence to a position adjacent the containers. The means for effecting the arcuate movement of the picker and gripper finger in timed relation so that the picker will present a label to the gripper finger at the place of transfer and the latter will take the label from the picker at the place of transfer and apply it to a container on the conveyor at the moment when a container is in a position for receiving the label is all disclosed in the aforesaid patent and therefor it is not necessary to describe it further herein. As previously stated there are three such assemblies comprising a magazine, a picker and a gripper finger in line on each side of the conveyor.

The wiper means (FIG. 9) comprise pads 30 supported at opposite sides of the conveyor on piston rods 32 for movement toward and from the path of travel of the containers to press labels which have been spotted on the containers by means of the label-applying means which precedes the wipers and such movement is provided for by pressure cylinders 34. To prolong the period of engagement of the wipers with the containers to insure attachment of the labels the wipers are movable bodily longitudinally along the path of movement of the containers and are mounted for this purpose on carriage bars 36 which are reciprocal longitudinally of the path of the conveyor so that the wipers are advanced toward the label-applying means to receive between them the containers, closed on the containers, moved away from the label-applying means in the direction of movement of the conveyor and then retracted from the containers. The mechanism for providing for such movement is disclosed in the aforesaid patent and accordingly need not be further described herein.

Referring now specifically to the picker 22, which is shown in FIGS. 4 and 5, it will be noted that it differs from those shown in the aforesaid patent in that it comprises a single plate 38 having at one end spaced parallel fingers 40—40 containing shallow, longitudinally extending recesses 42—42 at the bottoms of which are orifices 44—44. The distance between the fingers 40—40 corresponds approximately to the length of labels to be handled and the lengths of the fingers correspond substantially to the widths of the labels. The position of a label on the picker is shown in dotted lines. The orifices 44—44 are connected by suitable passages within the plate 38 to a nipple 46 to which a flexible conductor is adapted to be attached for applying vacuum to the orifices 44—44. The plate 38 is provided with a clamp jaw 48 by means of which it is bolted to a mating jaw 50 secured to the shaft 26.

The gripper finger 24 (FIGS. 6, 7 and 8) comprises an arm 52 having at its lower end a block 54 by means of which it is mounted on the shaft 28 and at its other end a pad 56 comprising a rigid block 58 to which is attached a resilient block 60. The resilient block 60 has in its face vertically spaced, transversely extending recesses 62—62, at the bottoms of which there are orifices 64—64 and these are connected by suitable passages extending from the orifices into the block 58 and from thence by a nipple 66 and flexible pipe 68 to a passage in the block 54. The passage in the block 54 is at times connected to a source of vacuum and at other times to a source of low pressure so that the label is vacuum held during movement from the magazine to the place of application and positively released at the place of application.

In accordance with this invention it is desirable to render the label tacky as it is being moved by the gripper finger from the place of transfer of the label from the picker to the gripper finger, to the place of application to the container so that the label may be spotted on the container by the gripper finger. For this purpose there is applied to the face of the pad 56 a thin flat metal plate 70 such as aluminum foil. Conductors 72, 74 are connected to the plate 70 so that the latter comprises a resistance in the electrical circuit from the wires 72, 74 and heats up to an extent to render the label which is held against its surface by the vacuum orifices 64—64 tacky or adhesive to the extent that when the gripper finger presses the label against the container at the place of label application the label will stick to the container. A temperature of aporoximately 250° to 300° F suffices. Both the picker and the gripper finger, as related, vacuum hold the label and there is suitable means in the form of valves for supplying the vacuum to the picker as it moves into engagement with a label at the bottom of the magazine and maintains the vacuum until the gripper finger takes the label from it at the place of transfer and at the place of transfer to cut off the vacuum until the picker returns to the magazine. Likewise, there is valve means (not shown) for connecting the orifices in the gripper finger to the vacuum as it moves to the transfer position and for maintaining it until it applies the label to the container whereupon it cuts off the vacuum and does not restore it until the gripper again approaches the transfer position. The valves may be controlled by cams on the cam shaft so that their operation is timed with the oscillation of the shafts 26 and 28.

As thus described the label-applying means operates to pick a dry level from the bottom of the label-applying magazine, move it to the transfer position and release it to the gripper which then takes the label and spots it on the side of a container. Three such assemblies comprising a picker and a gripper operate simultaneously from each side of the conveyor, although it is to be understood that only one such assembly may be provided and from one side only of the conveyor. The preferred labels are comprised of thermoplastic paper which will become tacky and adherent at a temperature of 250° to 300° F. Optionally, the labels may be comprised of non-thermoplastic paper and have a dry coating of thermoplastic applied thereto.

Beyond the label-applying means 14 there are, as previously related, wipers and, in accordance with this invention, the first group of three wipers at each side of the conveyor are heated so as to render the entire areas of the labels previously spotted on the containers adhesive and to wipe them firmly against the containers. Each of the wipers, as shown in FIGS. 10, 11 and 12, comprises a casting 76 by means of which it is mounted to the rod 32. The casting 76 pivotally supports arcuate jaws 78—78 to the concave sides of which is attached a relatively thick pad 80 comprised of silicone rubber. The jaws 78—78 have fixed thereto pins 82—82, the latter extending rearwardly therefrom and a coil spring 84 is connected at its opposite ends to the respective pins 82—82 so that the jaws are normally held distended as shown in FIG. 10. The extent of distention is controlled by screws 86—86. A heating element, for example a resistance wire or wires 88, are embedded in the silicone pad and connected by suitable electrical wires 92 and 94 so as to heat the pad to a temperature high enough to render the thermoplastic of the labels adhesive. A surface temperature of 300° to 350° suffices. A pencil form or flat plate thermostat and heat control box provides for controlling the temperature of the pad and to insure distribution of the heat over the entire area of the labels a thin metal plate, for example an aluminum plate 96, is secured to the concave side of the silicone pad by bracket members 98—98. As thus provided after the labels have been spotted on the containers the containers with the labels spotted thereon are received by the wipers on the forward movement of the wipers, clamped between the wipers and held clamped while the wipers move forwardly so that there is a sufficient length of time to insure obtaining uniform adhesion of the labels to the surfaces of the containers.

It should be understood that the present disclosure is for the purpose of illustration only and that this invention includes all modifications and equivalents falling within the scope of the appended claims.

I claim:

1. The method of applying thermoplastic labels to containers comprising vacuum picking dry thermoplastic labels one at a time from a stack of dry labels, transferring the dry labels to a place of application to a container, while making the transfer heating a portion of the label to render said portion tacky, pressing the tacky portion of the label against the container at the place of application and then while moving the container along a predetermined path away from said place of application heating the entire area of the label to make it adhesive and pressing it against the container.

2. The method of attaching labels which may be rendered adhesive to the sides of containers traveling along a predetermined path at a predetermined rate, comprising rendering a portion of the label tacky and at a predetermined place along said path pressing the tacky portion of the label to the sides of the container causing it to become attached thereto and thereafter while the container continues to travel a predetermined distance along said path pressing the entire area of the label into engagement with the side of the container and simultaneously rendering the entire area of the label uniformly adhesive to obtain uniform adhesion of the label to the container.

3. A method according to claim 2, comprising rendering said portion of the label tacky by subjecting said portion of the label to a temperature of 250°–300° F.

4. A method according to claim 2, comprising rendering the entire area of the label adhesive by subjecting the entire area of the label to a temperature of 300°–350° F.

5. The method of applying thermoplastic labels to containers comprising vacuum picking dry labels one at a time from a stack of dry labels, presenting the vacuum picked labels to a place of transfer, vacuum gripping the label at the place of transfer and moving it to a place of application, heating a portion of the label as it is moved from the place of gripping to the place of application, spotting the tacky portion of the label at the place of label application to the container, moving the container with the spotted label thereon along a predetermined path away from said place of label spotting, and while moving along said path rendering the entire area of the label adhesive and pressing its entire area against the container.

6. The method of applying thermoplastic labels to containers comprising reciprocably moving a vacuum picking element between a label holding magazine at a place of transfer to pick dry thermoplastic labels one at a time from the magazine and present them to the place of transfer, reciprocably moving a vacuum gripper finger from the place of transfer to a place of label application for taking the vacuum picked labels from the picker element and applying them to containers at the place of application, heating a portion of the label as it is taken by the gripper element and moved from said transfer position to said position of application to cause the label to become adhesively spotted to the container at the place of label application and thereafter moving the container away from the place of application along a predetermined path and while so moving it compressively wiping the entire surface of the label against the container and simultaneously heating the entire area of the label to render it adhesive.

7. In a labeling machine, label applying instrumentalities and a support for supporting and moving containers along a predetermined path relative to the label-applying instrumentalities, said instrumentalities comprising label applying means and label wiping means arranged along said path such that the containers are presented successively thereto, said label applying means comprising a magazine for holding a stack of labels adapted to be rendered adhesive by application of heat, a vacuum picker movable from the magazine to a transfer position and back for removing labels one at a time from the magazine and moving them to the transfer position and a vacuum gripper finger comprising a yieldable pad having a label pressing surface containing at its ends vacuum orifices, said vacuum gripper finger being movable from the transfer position to the support and back again to take labels from the vacuum picker and press them against the side of the container on the support, heating means on the gripper finger pad confined to a relatively small area of the pressing surface substantially midway between the orifices for rendering a correspondingly small area of the label intermediate its ends tacky so that the pressure applied by the pressing surface of the pad adheres the tacky area only of the label to the side of the container leaving the non-tacky portions unattached, and said wiping means comprising a wiping pad movable to and from the path of movement of the container and along the path of movement having a label pressing surface for pressing the entire area of the label against the side after it has been initially adhered to the side by the gripper finger, said wiping pad being arranged to be retained in engagement with the sides of the container for a predetermined length of time while traveling along said path and heating means coextensive with the label pressing surface of the wiping pad for rendering the entire area of the label adhesive while in compressive engagement with the container.

8. Apparatus according to claim 7, wherein there is means for moving the wiping means to and from the path of movement of the container and the heating means for the wiping pad is imbedded therein.

9. Apparatus according to claim 7, wherein the wiping pad has a concave face for wrapping the label about the sidewalls of the containers.

10. Apparatus according to claim 7, wherein articulated jaws supported for angular movement about a spaced parallel axis parallel to the surface of the container support the wiping pad for wrapping about the sides of the containers.

11. Apparatus according to claim 7, wherein the wiper pad has a concave face and there is a thin sheet of heat conductive metal attached to and co-extensive with said concave face of the wiper pad.

12. Apparatus according to claim 7, wherein the wiping means is reciprocably movable along the path of movement of the containers.

13. Apparatus according to claim 7, wherein there are several wipers situated along the path of movement of the containers such that each container will be subjected to as many wiping operations as there are wipers.

* * * * *